United States Patent [19]

Knapp et al.

[11] Patent Number: 4,946,394

[45] Date of Patent: Aug. 7, 1990

[54] CONNECTION MECHANISM FOR CONNECTING A CABLE CONNECTOR TO A BUSHING

[75] Inventors: Todd K. Knapp, Waukesha; Harvey W. Mikulecky, Oconomowoc, both of Wis.

[73] Assignee: Cooper Power Systems, Inc., Coraopolis, Pa.

[21] Appl. No.: 110,605

[22] Filed: Oct. 22, 1987

Related U.S. Application Data

[63] Continuation of Ser. No. 906,720, Sep. 12, 1986, abandoned.

[51] Int. Cl.[5] ..... H01R 13/62

[52] U.S. Cl. ..... 439/157; 439/480; 439/376

[58] Field of Search ..... 439/152, 153, 155, 157, 439/159, 160, 476, 477, 478, 480, 481, 483, 484, 921, 351, 352, 372, 299, 310, 341, 342, 376

[56] References Cited

U.S. PATENT DOCUMENTS

| | | | |
|---|---|---|---|
| 1,366,504 | 1/1921 | Sessions | 339/45 |
| 1,369,162 | 2/1921 | Boone | 339/45 |
| 1,739,421 | 12/1929 | Savage | 339/45 M |
| 1,939,103 | 5/1960 | Agron et al. | 339/75 |
| 2,217,496 | 10/1940 | Riley | 173/332 |
| 2,647,244 | 7/1953 | Dewey et al. | 339/45 |
| 2,710,329 | 6/1955 | Herterick | 219/20 |
| 3,119,645 | 1/1964 | Abbott et al. | 339/45 |
| 3,278,205 | 10/1966 | Barlow | 285/311 |
| 3,307,137 | 2/1967 | Tordoff et al. | 339/61 |
| 3,529,276 | 9/1970 | Hennessey, Jr. | 339/75 R |
| 3,720,904 | 3/1973 | DeSio | 339/34 |
| 3,823,290 | 7/1974 | Caton | 200/153 |
| 3,830,525 | 8/1974 | Ransford, III | 285/2 |
| 3,853,375 | 12/1974 | McClain | 339/60 |
| 3,883,208 | 5/1975 | Sankey | 339/111 |
| 3,918,786 | 11/1975 | Chaney et al. | 339/19 |
| 4,303,292 | 12/1981 | McNeel | 339/45 |
| 4,394,549 | 7/1983 | Dennis | 200/16 |
| 4,586,755 | 5/1986 | Hofmeister | 339/45 |

FOREIGN PATENT DOCUMENTS 2118786 3/1982 United Kingdom .

*Primary Examiner*—David Pirlot

*Attorney, Agent, or Firm*—Willian Brinks Olds Hofer Gilson & Lione

[57] ABSTRACT

A connection mechanism for connecting and disconnecting a cable connector to a bushing mounted on an electrical apparatus which is easier to use than cable connectors which require the threading of one electrical contact into another and which require more than one person to operate the connection mechanism. The connection mechanism assists in properly aligning the cable connector and the bushing and securely connects the cable connector to the bushing. Further, this connection mechanism eliminates the problem present in prior connection mechanisms of having to supply significant force in order to break the rubber-to-rubber interface bond which can occur when the connector has been connected to the bushing for a substantial period of time.

17 Claims, 2 Drawing Sheets

CONNECTION MECHANISM FOR CONNECTING A CABLE CONNECTOR TO A BUSHING

This application is a continuation of Ser. No. 906,720 filed Sept. 12, 1986, now abandoned.

BACKGROUND OF THE INVENTION

This invention relates to a connection mechanism for connecting and disconnecting a cable connector to a bushing mounted on an electrical apparatus and, more particularly, to such a connection mechanism which allows a single individual to quickly connect and disconnect the cable connector and the bushing.

A cable connector, such as a visible break deadfront type T-connector, is used to connect a high voltage primary cable to a bushing on an electrical apparatus such as a transformer or padmounted switchgear. Presently, T-connectors are connected to the bushing, in most cases, by having a threaded male member within the T-connector received in a threaded female receptacle in the switchgear bushing. The threaded male member of the T-connector must be rotated by the individual making the connection. For safety reasons, this rotation of the male member is usually accomplished by rotating a hot stick connected to a tool connected to the male member.

Because one operator must use the hot stick to hold the T-connector, while another operator rotates the male member to secure the T-connector to the bushing, it is difficult to properly align the bushing and the T-connector so as to get a clean engagement of the two threaded pieces. This is also made even more difficult because the cables are quite thick and very stiff. As a result, the threaded members can become stripped. An illustration of the present or most commonly used type of connection mechanism is illustrated in Sankey et al U.S. Pat. No. 3,883,208 issued May 13, 1975, which is incorporated herein by reference.

In some other connection mechanisms, non-threaded contact members have been used and a strap connected to the switchgear face has been used to hold the cable connector to the bushing. The strap is merely slipped over the cable connector and tightened after the connector is placed on the bushing.

In addition to the difficulty incurred in trying to properly align the cable connector and the bushing, the connector and bushing are usually made of elastomeric material which tends to stick when in contact for a long period of time. It is therefore often difficult for someone to separate the connector from the bushing.

SUMMARY OF THE PRESENT INVENTION

This invention provides a connection mechanism for connecting and disconnecting a cable connector to a bushing mounted on an electrical apparatus which mechanism is easier to use than cable connectors which require the threading of one electrical contact into another. Further, the connection mechanism of this invention can be operated by a single operator because the connection mechanism assists in properly aligning the cable connector and the bushing and eliminates the need for separate connector holding and contact turning operations. Further this connection mechanism eliminates the problem present in prior connection mechanisms of having to have an operator supply significant force in order to break the rubber-to-rubber interface bond which can occur when the connector has been connected to the bushing for a substantial period of time.

More particularly, the connection mechanism comprises a saddle shroud adapted to be connected to the cable connector and adapted to be movable by a shotgun stick and a lever mechanism adapted to be pivotally connected adjacent the bushing to the electrical apparatus and having a pair of notches which releasably receives and drives the saddle shroud so that the cable connector is forced onto the bushing when the lever mechanism is pivoted in one direction and the cable connector is forced away from the bushing when the lever mechanism is pivoted in the opposite direction. The connection mechanism also include means adapted to be connected adjacent the bushing to the electrical apparatus for receiving and releasably preventing pivoting of the lever mechanism in the opposite direction after the cable connector is forced onto the bushing.

In one embodiment of the invention, the saddle shroud includes a pair of bosses extending in opposite directions from the saddle shroud and the lever mechanism includes a pair of spaced apart bail arms adapted to be pivotally connected to the electrical apparatus adjacent the bushing and each of the bail arms has one of the notches and each of the notches releasably receives and drives one of the bosses.

This invention also provides a connection mechanism comprising a saddle shroud adapted to be connected to the cable connector and adapted to be movable by a shotgun stick, and means adapted to be connected to the electrical apparatus adjacent the bushing for receiving and releasably locking in multiple positions the saddle shroud adjacent the electrical apparatus as the cable connector is forced onto the bushing.

In one embodiment, the receiving and releasably locking means comprises a ratchet latch mechanism connected to the electrical apparatus adjacent the bushing, and lever means adapted to be pivotally connected to the electrical apparatus adjacent the bushing for releasably receiving and driving the saddle shroud so that the cable connector is forced onto the bushing when the lever means is pivoted in one direction and so that the cable connector is forced away from the bushing when the lever means is pivoted in the opposite direction. Further, the lever means includes a ratchet arm releasably connectable in multiple locking positions to the ratchet latch bracket.

Other features and benefits of the invention are more particularly set forth in the attached drawings, description and appended claims.

DESCRIPTION OF THE PREFERRED EMBODIMENTS

Figure 1:
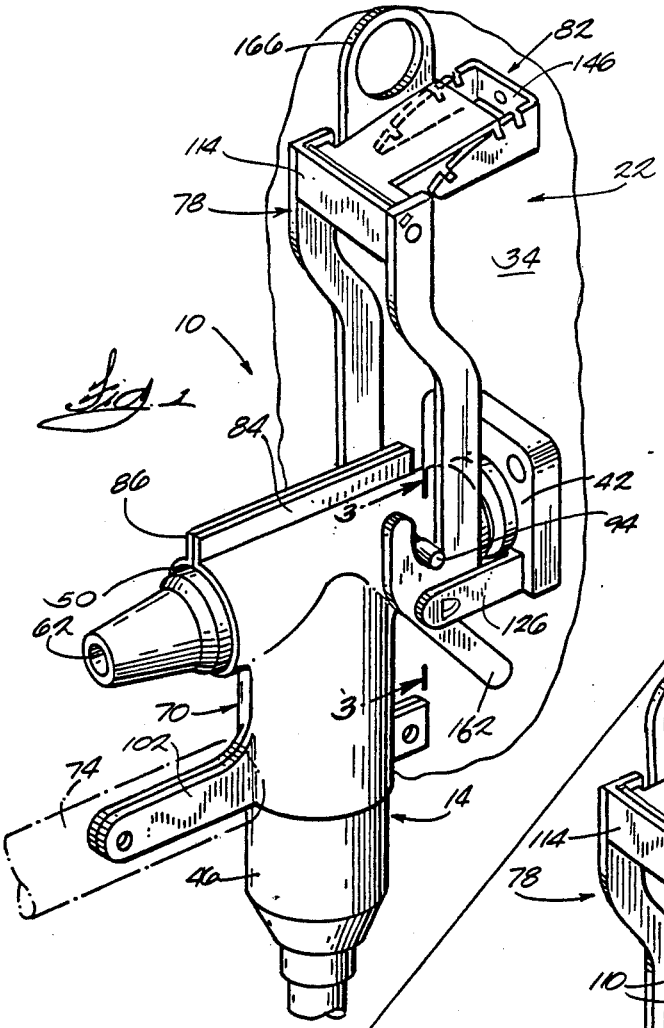
FIG. 1 is a perspective side view of a connection mechanism for connecting and disconnecting a cable connector to a bushing mounted on an electrical apparatus, which mechanism embodies various of the features of the invention.
Figure 3:
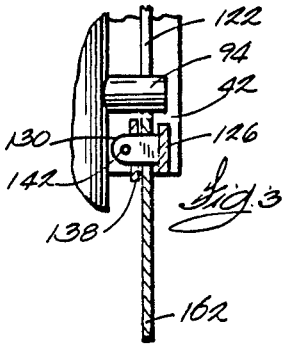
FIG. 3 is a cross sectional view of a portion of the connection mechanism taken along the line 3—3 in FIG. 1.

Illustrated in the drawings is a connection mechanism 10 for connecting and disconnecting a cable connector, such as a visible break T-type connector 14, to a bushing 18 mounted on an electrical apparatus, such as pad-mounted switchgear 22. The visible break T-connector 14 is used to connect a high voltage cable 26 to the switchgear bushing 18. The switchgear bushing includes a housing having an outer conical portion 30 which extends from the switchgear face 34. The conical portion 30 of the bushing 18 includes a central cylindrical passageway 38 having therein an electrical contact 40, which is connected to wiring inside the switchgear 22. The bushing 18 is supported on the face of the switchgear by a mounting plate 42.

Figure 2:
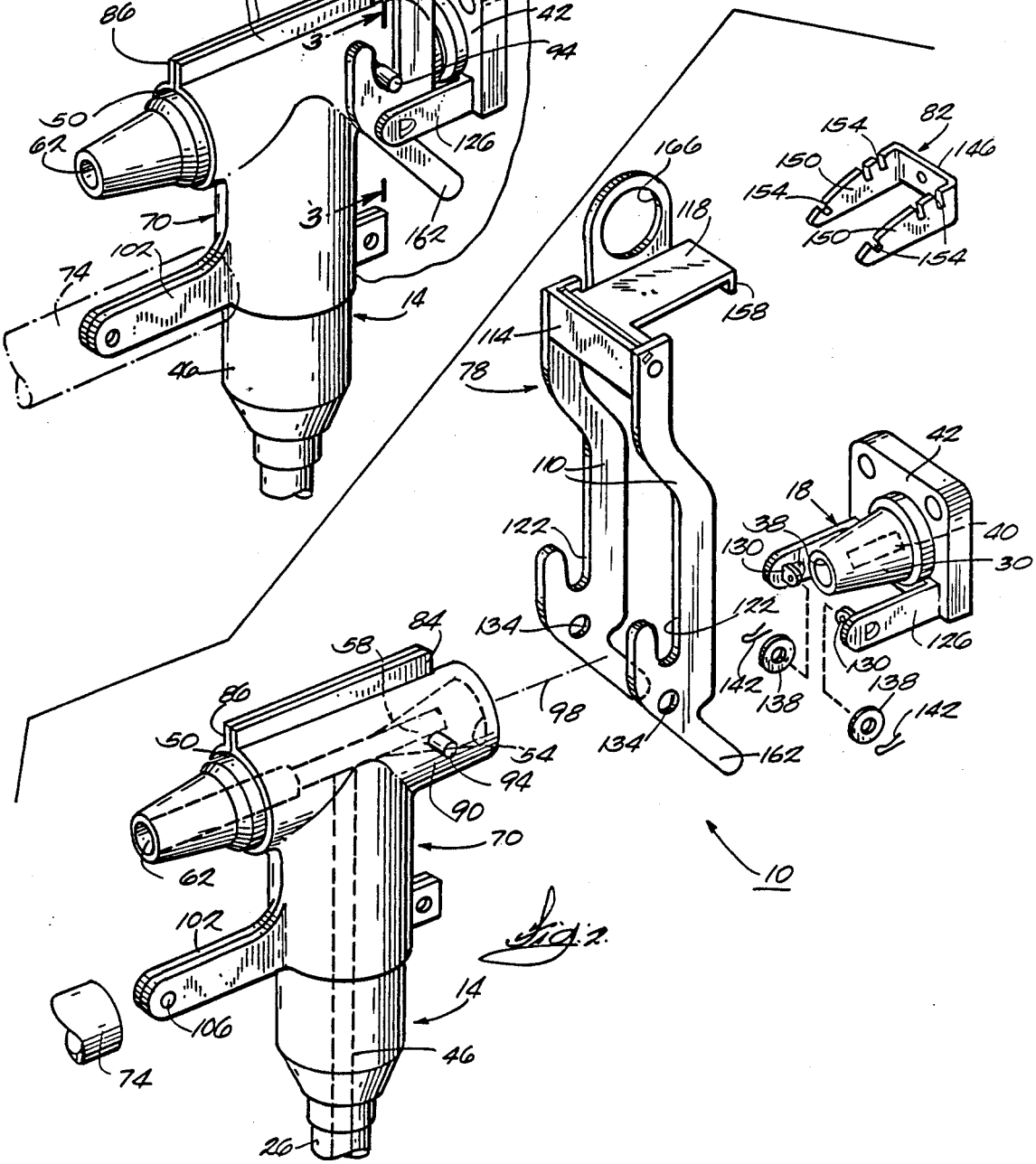
FIG. 2 is an exploded view of a portion of the connection mechanism, cable connector and bushing illustrated in FIG. 1.

The visible break T-connector 14 includes a body having a general T-shape with a lower portion 46 housing the end of the cable 26 and an upper portion 50 having a first opening 54 (FIG. 2) which receives the conical portion 30 of the bushing 18. Mounted within the first opening 54 in the T-connector 14 is an electrical contact 58 connected to the high voltage cable 26, which contact 58 engages the contact 40 located within the bushing 18 when the conical portion 30 of the bushing 18 is received within the first opening 54 in the T-connector 14. The first opening 54 in the T-connector 14 has a conical surface which interfaces with the conical interface of the bushing 18 to provide an air tight seal between the T-connector and the bushing 18.

The T-connector upper portion 50 also includes a second opening 62 which is coaxial with the first opening 54, and which allows for insertion of a probe (not shown) into the T-connector 14 in order to determine whether the high voltage cable 26 has been de-energized.

The connection mechanism of the invention comprises a saddle shroud 70 adapted to be connected to the cable connector 14 and adapted to be movable by a shotgun stick 74, and means adapted to be connected to the switchgear 22 adjacent the bushing 18 for receiving and releasably locking in multiple positions the saddle shroud 70 adjacent the switchgear 22 a the cable connector 14 is forced onto the bushing 18. More particularly, the receiving and releasably locking means is in the form of a lever mechanism 78 pivotally connected adjacent the bushing 18 to the switchgear 22, and a ratchet latch bracket 82 adjacent the bushing and connected to the switchgear 22.

The saddle shroud 70 is in the form of two metal half portions 84 and 86, respectively, which when connected to one another generally conform to the outer shape of the T-connector 14. More particularly, the halves of the saddle shroud 70 are adapted to be placed around the T-connector 14 and connected one to the other so as to substantially cover the T-connector 14, and a barrel portion 90 of the shroud 70 includes the upper portion 50 of the connector 14 which houses the bushing receiving first opening 54. Extending radially outwardly in opposite directions from the saddle shroud barrel portion 90 are a pair of bosses 94 (only one shown). The cable connector 14 and bushing 18 are connectable when the connector 14 is moved relative to the bushing 18 along an axis 98 which extends through the central opening 38 in the center of the bushing 18 and the first opening 54 in the T-connector 14, and the bosses 94 extend perpendicular to this axis 98 along a generally horizontal line. The saddle shroud 70 further includes a handle 102 including a pull ring eye 106 in order to permit connection of the shotgun stick 74 to the saddle shroud 70.

The lever mechanism 78 includes a pair of spaced apart bail lever arms 110 connected at their upper ends by a plate member 114 and a ratchet arm 118 pivotally mounted between the upper ends of the bail lower arms 110 and engagable with the ratchet latch bracket 82. A bar 120 extends between the upper ends of the bail lever arms 110 and above the point of pivotal connection of the ratchet arm 118 to the bail arms 110 so that the ratchet arm 118 can pivot back only so far as to insure that the ratchet arm 118 will always pivot toward the switchgear face 34 under the influence of gravity. Each of the bail lever arms 110 has a notch 122 which releasably receives and drives one of the bosses 94 on the saddle shroud 70, as more particularly described below.

The pair of spaced apart bail lever arms 110 are pivotally connected to the switchgear 22 by means of two spaced apart support arms 126 connected to the bushing mounting plate 42. The support arms 126 each include a stamped out ear 130 which extends towards the other support arm 126. The spaced apart bail lever arms 110 include openings 134 for receiving the stamped out ears 130. A washer 138 and cotter pin 142 arrangement is used to releasably hold each bail lever arm 110 to the respective support arm 126.

The ratchet latch bracket 82 comprises a support plate 146 connected to the switchgear face 34 adjacent and above the switchgear bushing 18, and two vertically disposed spaced apart latch plates 150 having an upper surface with a number of spaced apart notches 154 for releasably receiving the end of the ratchet arm 118. The ratchet arm end has a latch finger 158 angled back at about five degrees toward the plate member 114 so that the ratchet arm 118 can easily move toward the switchgear face 34 but is held securely when the latch finger 158 is received in one of the notches 154 on the ratchet latch bracket 82.

When the shotgun stick 74 is connected to the handle 102 on the saddle shroud 70, as generally illustrated in FIG. 1, an operator controlling the shotgun stick 74 can move the saddle shroud 70 around. When the ratchet arm 118 is free from engagement with the ratchet latch bracket 82, the bail lever arms 110 are so located that an operator can move the saddle shroud bosses 94 toward the bushing 18 and into the notches 122. The notches 122 on the bail lever arms 110 are held in a position ready to receive the saddle shroud 70 by each of the lever arms 110 having a downwardly depending extension 162 which is angled toward the switchgear face 34 below the switchgear bushing 18 and which engages the underneath edge of the bushing mounting plate 42 when the lever arms 110 are pivoted out in order to receive the saddle shroud bosses 94.

With the bosses 94 loosely received in the notches 122 on the bail lever arms 110, the first opening 54 in the T-connector 14 can be aligned with the switchgear bushing 18. After the bosses 94 of the saddle shroud 70 are received in the notches 122 on the spaced apart bail arms 110, the operator can push the saddle shroud 70 towards the switchgear face 34 and thereby cause the ratchet arm 118 to engage the first notch 154 in the ratchet latch bracket 82. This locates the conical portion 30 of the bushing 18 in the T-connector first opening 54 and locates the spaced apart bail arms 110 in a generally upright position to facilitate further engagement of the T-connector 14 and the bushing 18. Next, the operator can remove the shotgun stick 74 from the handle 102 on the saddle shroud 70 and move the shotgun stick 74 to the plate member 114 which connects the upper ends of the spaced apart bail arms 110. The operator can then push on the plate member 114, and, with the benefit of the leverage provided by the bail lever arms 110, thereby force the T-connector 14 onto the bushing 18 so that the outer surface of the bushing conical portion 30 is engaged by the inner surface of the first opening 54. As the plate member 114 is moved forward the ratchet arm 118 progresses along the upper edge of the ratchet latch bracket 82 and is received in various notches 154 along the upper edge of the ratchet latch bracket 82 so that the saddle shroud 70 and T-connector 14 are releasably locked in multiple positions as the bail lever arms 110 are pivoted towards the switchgear face 34.

In order to disconnect the cable connector 14 from the bushing 18, the operator has the shotgun stick 74 engage an eye 166 extending upwardly from the ratchet arm 118. By pulling on the ratchet arm hook stick eye 166, the operator can disengage the ratchet arm 118 from the ratchet latch bracket 82 thereby unlocking the bail lever arms 110 and pivoting the bail lever arms 110 away from the switchgear face 34. When the bail lever arms 110 are pivoted away from the switchgear face 34, the saddle shroud 70 is forced away from the bushing 18 thereby breaking the contact between the bushing 18 and the T-connector 14 and disconnecting the bushing 18 and cable connector 14.

Figure 4:
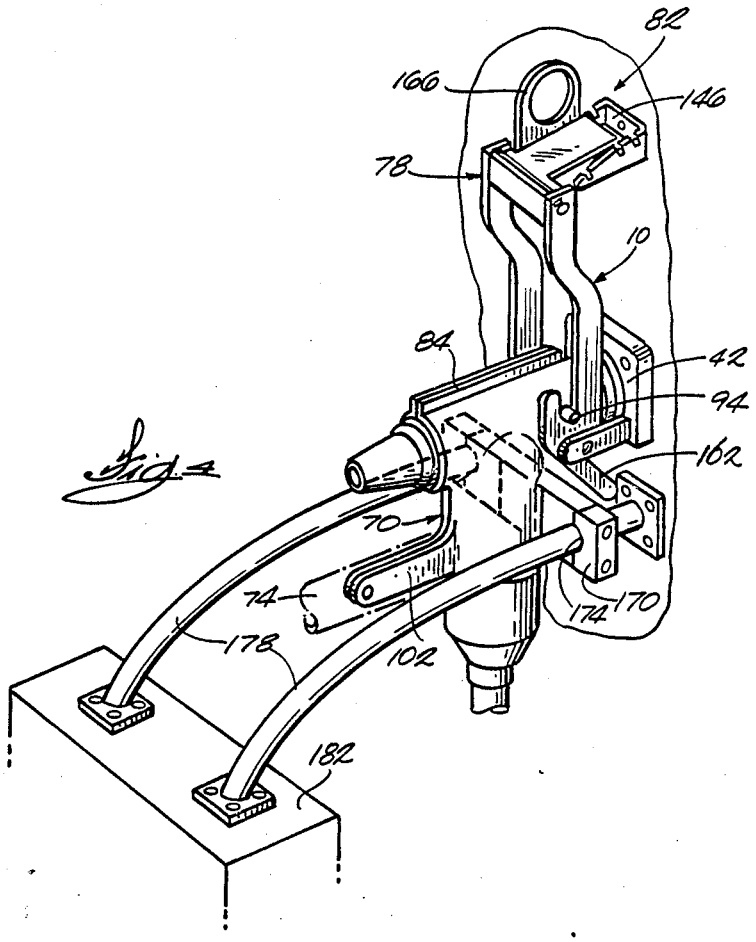
FIG. 4 is a perspective view of an alternate embodiment of the invention; an FIG. 5 is a perspective view of another alternate embodiment of the invention.

In another embodiment shown in FIG. 4, the connection mechanism can include means for facilitating the guiding of the cable connector and saddle shroud towards the switchgear bushing. This guiding mechanism can take the form of a bracket 170 connected to the saddle shroud 70 which includes spaced apart openings 174 which receive guide pipes 178 which extend between the switchgear face 34 and a support 182.

Figure 5:
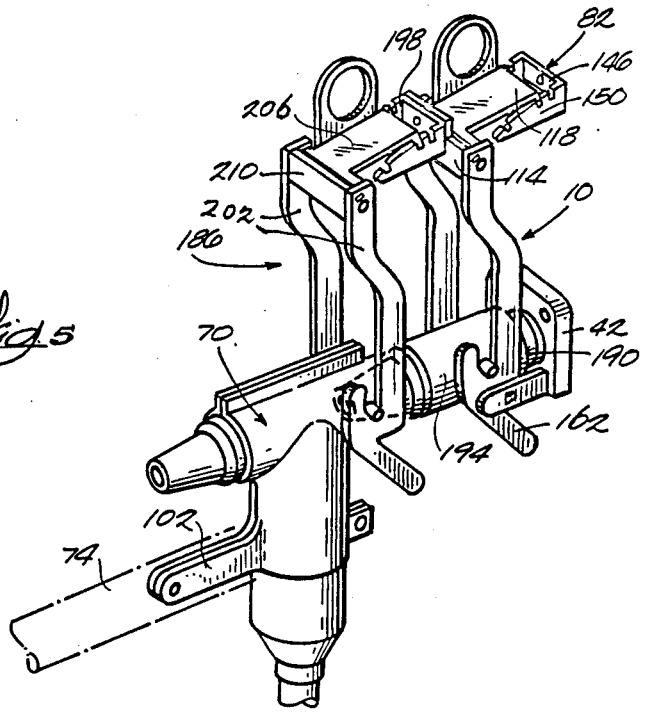

In still another embodiment, as illustrated in FIG. 5, an intermediate connector 186 is used when it is desirable to have an intermediate or piggy-back member 190 interposed between the cable connector 14 and the bushing 18. The piggy-back member 190 can include a conductive shield connected to ground (not shown), if so desired. In this embodiment, a saddle shroud 194 with bosses and conforming to the shape of the piggy-back member 190 is connected t the piggy-back member 190 and the piggy-back member 190 is connected to the bushing 18 by the connection mechanism 10 described above. The T-connector 14 is connected to the piggy-back member 190 by having a second ratchet latch bracket 198 connected to the plate member 114 connecting the spaced apart bail arms 110. A second pair of spaced apart bail lever arms 202 holds the saddle shroud 70, and the bail lever arms 202 are pivotally supported on support arms 212 bracketed to the piggy-back member 190. When the saddle shroud 70 and T-connector 14 are forced onto the piggy-back member 190, a ratchet arm 206 on the plate member 210 connecting the second pair of spaced bail lever arms 202 engages the second ratchet latch bracket 198.

Various of the features of the invention are set forth in the following claims.

We claim:

1. A connection mechanism for connecting and disconnecting a cable connector to a bushing mounted on an electrical apparatus, said mechanism comprising:

a saddle shroud adapted to be connected to the cable connector and adapted to be movable by a shotgun stick, means adapted to be connected adjacent the bushing to the electrical apparatus for receiving and releasably locking said saddle shroud adjacent the electrical apparatus as the cable connector is forced onto the bushing, and a lever mechanism adapted to be pivotally connected adjacent the bushing to the electrical apparatus and having a pair of notches which releasably receives and drives said saddle shroud so that the cable connector is forced onto the bushing when said lever mechanism is pivoted in one direction and so that the cable connector is forced away from the bushing when said lever mechanism is pivoted in the opposite direction, and wherein said locking means adapted to be connected to the electrical apparatus adjacent the bushing locks in multiple positions said saddle shroud adjacent the electrical apparatus as the cable connector is forced onto the bushing.

2. A connection mechanism for connecting and disconnecting a cable connector to a bushing mounted on an electrical apparatus, said mechanism comprising:

a saddle shroud adapted to be connected to the cable connector and adapted to be movable by a shotgun stick, and means adapted to be connected adjacent the bushing to the electrical apparatus for receiving and releasably locking said saddle shroud in multiple positions spaced along the bushing and adjacent the electrical apparatus after the cable connector is initially moved onto the bushing so that the connector cannot move off of the bushing without a release of said connector from one of said locked positions.

3. A connection mechanism for connecting and disconnecting a cable connector to a bushing mounted on an electrical apparatus, said mechanism comprising:

a saddle shroud adapted to be connected to the cable connector and adapted to be movable by a shotgun stick, and means adapted to be connected adjacent the bushing to the electrical apparatus for receiving and releasably locking in multiple positions said saddle shroud adjacent the electrical apparatus as the cable connector is forced onto the bushing, said receiving and releasably locking means comprising:

a ratchet latch bracket connected to the electrical apparatus adjacent the bushing, and lever means adapted to be pivotally connected adjacent the bushing to the electrical apparatus for releasably receiving and driving said saddle shroud so that said cable connector is forced onto the bushing when said lever means is pivoted in one direction and so that the cable connector is forced away from the bushing when said lever means is pivoted in the opposite direction, said lever means including a ratchet arm releasably connectable in multiple locking positions to said ratchet latch bracket.

4. A connection mechanism for connecting and disconnecting a cable connector to a bushing mounted on an electrical apparatus, said mechanism comprising:

a support bracket adapted to be connected adjacent and on one side of the bushing to the electrical apparatus;

a ratchet latch bracket connected to the electrical apparatus adjacent and on the opposite side of the bushing;

a saddle shroud adapted to be connected to the cable connector and including a barrel portion adapted to receive the cable connector, a shotgun stick handle having a hookeye, and a pair of bosses extending radially outward in opposite directions from said barrel portion, and means for releasably securing the saddle shroud to the bushing, said securing means comprising a lever mechanism including a pair of spaced apart lever arms, each of which has two ends and is pivotally connected near one end to said support bracket, and each of which has a notch which releasably receives and drives one of said pair of bosses, a cross bar connecting the other ends of said lever arms, and a ratchet arm releasably connectable to said ratchet latch bracket.

5. A connection mechanism in accordance with claim 4 wherein said ratchet arm includes a hookeye.

6. A connection mechanism in accordance with claim 4 wherein the cable connector and bushing are connectable when the connector is moved relative to the bushing along an axis extending through the center of the bushing, and wherein said bosses extend perpendicular to the axis.

7. A connection mechanism in accordance with claim 4 wherein each of said notches is spaced from where each of said lever arms is pivotally connected to said support bracket.

8. A connection mechanism in accordance with claim 4 and further including means for facilitating the guiding of said saddle shroud toward the bushing.

9. A connection mechanism in accordance with claim 4 and further including a piggy-back member adapted to be received between the cable connector and the bushing.

10. A connection mechanism for connecting and disconnecting a cable connector to a bushing mounted on an electrical apparatus, said mechanism comprising:

a saddle shroud adapted to be connected to the cable connector and adapted to be movable by a shotgun stick, a lever mechanism adapted to be pivotally connected adjacent the bushing to the electrical apparatus and having a pair of notches which releasably receives and drives said saddle shroud so that the cable connector is forced onto the bushing when said lever mechanism is pivoted in one direction and the cable connector is forced away from the bushing when said lever mechanism is pivoted in the opposite direction, and means adapted to be connected to the electrical apparatus adjacent the bushing for receiving said lever mechanism as the cable connector is forced onto the bushing and for releasably preventing pivoting of said lever mechanism in said opposite direction after the cable connector is forced onto the bushing.

11. A connector mechanism in accordance with claim 10 wherein said lever mechanism includes a ratchet arm, and wherein said receiving and releasably preventing pivoting means comprises a ratchet latch bracket which is connected to the electrical apparatus adjacent the bushing and which is releasably engaged by said ratchet arm.

12. A connection mechanism in accordance with claim 10 wherein said saddle shroud includes a pair of bosses extending in opposite directions from said saddle shroud, and wherein said lever mechanism includes a pair of spaced apart bail arms adapted to be pivotally connected to the electrical apparatus adjacent the bushing, and each of said bail arms has one of said notches and each of said notches releasably receives and drives one of said bosses.

13. A connection mechanism for connecting and disconnecting a cable connector to a tapered bushing mounted on an electrical apparatus, said mechanism comprising:

a saddle shroud adapted to be connected to the cable connector and adapted to be movable by a shotgun stick, and including a pair of bosses extending in opposite directions from said saddle shroud, and means for receiving said shroud, for aligning the cable connector with the bushing, and for driving the connector onto and away from the bushing, said means comprising:

a lever mechanism having a pair of notches, each of which has an open end and a closed end, said lever mechanism being adapted to be pivotally connected adjacent the bushing to the electrical apparatus so as to be pivotable in one direction such that said notches are guided along a predetermined curvilinear path of travel toward the tapered bushing and so as to be pivotable in the opposite direction into a predetermined open position in which said notches are disposed so as to releasably receive said bosses and to guide the cable connector in a position of alignment with the bushing, whereby said lever mechanism can urge the cable connector onto the tapered bushing when said lever mechanism is pivoted in the one direction, and said lever mechanism can release the cable connector away from the tapered bushing when said lever mechanism is pivoted in the opposite direction.

14. A connection mechanism in accordance with claim 13 wherein said lever mechanism further includes means for limiting the extent of movement of the lever mechanism in said opposite direction so that the open end of each of said notches remains above the closed end of said notches.

15. A connection mechanism in accordance with claim 14 wherein the electrical apparatus further includes a bushing mounting bracket surrounding the bushing and wherein said movement limiting means comprises a lower extension which engages the bushing mounting bracket when said lever mechanism is pivoted in said opposite direction.

16. A connection mechanism for connection and disconnecting a cable connector to a bushing mounted on an electrical apparatus, said mechanism comprising:

a saddle shroud adapted to be connected to the cable connector and adapted t be movable by a shotgun stick, a lever mechanism adapted to be pivotally connected adjacent the bushing to the electrical apparatus and having a pair of notches which releasably receives and drives said saddle shroud so that the cable connector is forced onto the bushing when said lever mechanism is pivoted in one direction and the cable connector is forced away from the bushing when said lever mechanism is pivoted in the opposite direction, and means adapted to be connected to the electrical apparatus adjacent the bushing for receiving said lever mechanism as the cable connector is forced onto the bushing and for releasably preventing pivoting of said lever mechanism in said opposite direction after the cable connector is forced onto the bushing, said receiving and releasably preventing pivoting means comprising a ratchet latch bracket which is connected to the electrical apparatus adjacent the bushing and which is releasably engaged by a ratchet arm.

17. A connection mechanism for connecting and disconnecting a cable connector to a bushing mounted on an electrical apparatus, said mechanism comprising:

a saddle shroud adapted to be connected to the cable connector and adapted to be movable by a shotgun stick, and including a pair of bosses extending in opposite directions from said saddle shroud, and means for receiving said shroud, for aligning the cable connector with the bushing, and for driving the connector onto and away from the bushing, said means comprising:

a lever mechanism having a pair of notches, each of which has an open end and a closed end, said lever mechanism being adapted to be pivotally connected adjacent the bushing to the electrical apparatus so that said notches releasably support, receive and drive said bosses wit the result that the cable connector is forced onto the bushing when said lever mechanism is pivoted in one direction and said cable connector is forced away from said bushing when said lever mechanism is pivoted int eh opposite direction, and, so that, when said bosses are bottomed in said closed end of said notches, the cable connector is generally aligned with the bushing before said lever mechanism is pivoted in said one direction, said lever mechanism including means for limiting the movement of the lever mechanism in said opposite direction so that the open end of each of said notches remains above the closed end of said notches, wherein the electrical apparatus includes a bushing mounting bracket surrounding the bushing and wherein said movement limiting means comprises a lower extension which engages the bushing mounting bracket when said lever mechanism is pivoted in said opposite direction.

* * * * *

UNITED STATES PATENT AND TRADEMARK OFFICE

CERTIFICATE OF CORRECTION

PATENT NO. : 4,946,394

DATED : August 7, 1990

INVENTOR(S) : Todd K. Knapp et al.

It is certified that error appears in the above-identified patent and that said Letters Patent is hereby corrected as shown below:

In column 1, line 64, after "Further" please insert --,--.

In column 3, line 44, after "22" please delete "a" and substitute therefor --as--.

In column 5, line 48, after "connected" please delete "t" and substitute therefor --to--.

Column 8:

In claim 16, line 1, please delete "connection" and substitute therefor --connecting--; and in line 5, please delete "t" and substitute therefor --to--.

UNITED STATES PATENT AND TRADEMARK OFFICE

CERTIFICATE OF CORRECTION

PATENT NO. : 4,946,394

DATED : August 7, 1990

INVENTOR(S) : Todd K. Knapp et al.

It is certified that error appears in the above-identified patent and that said Letters Patent is hereby corrected as shown below:

Column 10:

In claim 17, line 17, please delete "wit" and substitute therefor --with--; and in lines 21 and 22, please delete "int eh" and substitute therefor --in the--.

Signed and Sealed this

Eighth Day of December, 1992

*Attest:*

DOUGLAS B. COMER

*Attesting Officer*

*Acting Commissioner of Patents and Trademarks*